US008472863B2

(12) United States Patent
Sheby et al.

(10) Patent No.: US 8,472,863 B2
(45) Date of Patent: Jun. 25, 2013

(54) METHOD AND APPARATUS FOR HEAVY-TAILED WAVEFORM GENERATION USED FOR COMMUNICATION DISRUPTION

(75) Inventors: David Sheby, Cherry Hill, NJ (US); Emmanuel Kanterakis, North Brunswick, NJ (US)

(73) Assignee: Bank of America, N.A., Chicago, IL (US)

( * ) Notice: Subject to any disclaimer, the term of this patent is extended or adjusted under 35 U.S.C. 154(b) by 642 days.

(21) Appl. No.: 12/314,424

(22) Filed: Dec. 10, 2008

(65) Prior Publication Data

US 2009/0156116 A1 Jun. 18, 2009

Related U.S. Application Data

(60) Provisional application No. 60/996,956, filed on Dec. 12, 2007.

(51) Int. Cl.
*H04K 3/00* (2006.01)

(52) U.S. Cl.
USPC ..... 455/1; 342/13; 342/14

(58) Field of Classification Search
USPC ..... 455/1, 102, 112, 118, 67.13; 342/13, 342/14
See application file for complete search history.

(56) References Cited

U.S. PATENT DOCUMENTS

| | | | | |
|---|---|---|---|---|
| 4,149,167 | A * | 4/1979 | Peters et al. | 342/14 |
| 5,220,680 | A * | 6/1993 | Lee | 455/102 |
| 5,623,266 | A * | 4/1997 | Grigsby | 342/14 |
| 6,026,125 | A * | 2/2000 | Larrick et al. | 375/295 |
| 2009/0003418 | A1 * | 1/2009 | Karabinis | 375/219 |
| 2009/0061759 | A1 * | 3/2009 | Stoddard et al. | 455/1 |

* cited by examiner

*Primary Examiner* — Raymond Dean
(74) *Attorney, Agent, or Firm* — Stites & Harbison PLLC; Juan Carlos A. Marquez, Esq.

(57) ABSTRACT

The present invention has application to countering IEDs which are triggered remotely through a RF signal directed at, or the same operating environment as, receiver components embedded in, or part of, commercially manufactured cell phones or remote control devices. The invention exploits those situations where the underlying device (i.e., a commercial cell phone) is designed to operate in an environment where noise is characterized by an additive Gaussian noise model. The invention exploits the optimization of the matched filter for Gaussian noise by introducing a specific non-Gaussian noise. Further, the invention is directed to a family of jamming waveforms which exhibit increased effectiveness against a variety of digital and analog communications systems.

17 Claims, 10 Drawing Sheets

METHOD AND APPARATUS FOR HEAVY-TAILED WAVEFORM GENERATION USED FOR COMMUNICATION DISRUPTION

BACKGROUND OF THE INVENTION

The present invention relates to a method and apparatus for disruption of signal reception, and processing, in sensors (receivers) attempting detection, and interpretation, of transmitted signals-of-interest. The present invention impedes operation of (radar, sonar, and communications) receivers by inserting into the operating environment a heavy-tailed (HT) noise sequence as a jamming signal. The present invention exploits weaknesses inherent in receivers that are designed to operate in environments where the noise is modeled as additive Gaussian white noise (AGWN). The present invention describes a noise generation process, and resulting sequences, for random variables (r.v.) drawn from Pareto, Levy, Weibull, and other heavy-tail probability distribution functions (PDFs) of random variables, which have the effect of exploiting such receivers' non-optimal capabilities in non-Gaussian environments. In probability theory, heavy-tailed distributions are probability distributions whose tails are not exponentially bounded: that is, they have heavier tails than the exponential distribution. In many applications it is the right tail of the distribution that is of interest, but a distribution may have a heavy left tail, or both tails may be heavy. There are two important subclasses of heavy-tailed distributions, the long-tailed distributions and the subexponential distributions. In practice, all commonly used heavy-tailed distributions belong to the subexponential class. The present invention was motivated by the need to disrupt improvised explosive devices (IED): many of which have been designed to be triggered remotely through a radio frequency (RF) signal directed at receiver components embedded in, or part of, commercially manufactured cell phones, or remote-control devices (whose original function was intended for hobbyist cars/aircraft or for garage doors).

Under various assumptions, preliminary simulations indicate that jamming waveforms derived from heavy-tailed distributions outperform traditional AWGN jamming by as much as 10 dB versus when conventional Gaussian type of waveforms are used in jamming GSM cellular communications networks.

SUMMARY OF THE INVENTION

The present invention generates a noise signal $S_{jam}$ which results in a lower probability of identifying the correct contents of a signal-of-interest than currently known jamming signals. The present invention targets two aspects of general communication receivers. First they are designed to operate optimally mainly in Gaussian noise environments, and second the use of forward error correction (FEC) coding which operates on packets or frames, thus having a periodic operation. Jamming signals which are more specifically targeting the first or the second above mentioned aspects of communication systems are categorized here as Type I and Type II respectively. Type I jamming signals are simple signals whose amplitudes are distributed according to heavy-tail distributions. They are effective in jamming communication systems which tend to have high resolution analog to digital converters at the front end and no special amplitude limiting along their processing chains. These types of receivers are mostly software defined and in general belong to a more versatile class of receivers. Type II jamming signals are more complex than Type I and are meant to jam communication systems which utilize FEC coding. Type II waveforms are also heavy-tail distributed, however their statistics can be non-stationary and they are implemented by the multiplication of two noise signals of which at least one is heavy-tail distributed. Note that certain heavy-tailed distribution families (such as the Levy alpha-stable) also contain the Gaussian distribution as a special degenerate case. This implies that the product of a heavy-tail distribution with a Gaussian distribution also includes the case of the product of a Gaussian with a Gaussian. Both Type-I and Type II jamming signals are generated from "heavy-tailed" distributions, and both contain large-amplitude events which occur with greater probability than if generated based on Gaussian distributions. Because heavy-tail distributions in general have unbounded variances, this invention also provides mechanisms by which realistic, i.e., finite power jamming signals are generated without loosing the qualities inherent in heavy-tail distributions. In achieving this, the magnitude of the generated signals needs to be constrained in some way.

The invention is realized by generating a sequence $S_{jam}$, in digital form, $S_{jam}(n)$, in discrete time or in analog form, $S_{jam}(t)$, in continuous time, with specific heavy-tailed properties.

In certain applications, the implications of the present invention's jamming signal are of profound significance. For example, in increasing the effective jamming distance the potential is created to disable RF-triggered IEDs from a greater distance and to increase the margin of safety for those charged with neutralizing IEDs.

The present invention is intended to address the need for novel jamming waveforms which present the sophistication needed to affect modem communication systems of various types. The present invention discloses the generation of a general class of jamming waveforms which can be tailored to effectively jam specific systems from a large family of systems operating under various different operational parameters. The class of jamming waveforms is obtained by changing various tunable parameters governing their generation. Prior knowledge of signal specifics can be used to optimize the effectiveness of the jamming signals.

BRIEF DESCRIPTION OF THE DRAWINGS

The present invention is described below in conjunction with the accompanying drawings illustrating the invention.

DETAILED DESCRIPTION OF THE PREFERRED EMBODIMENTS

Figure 1A:
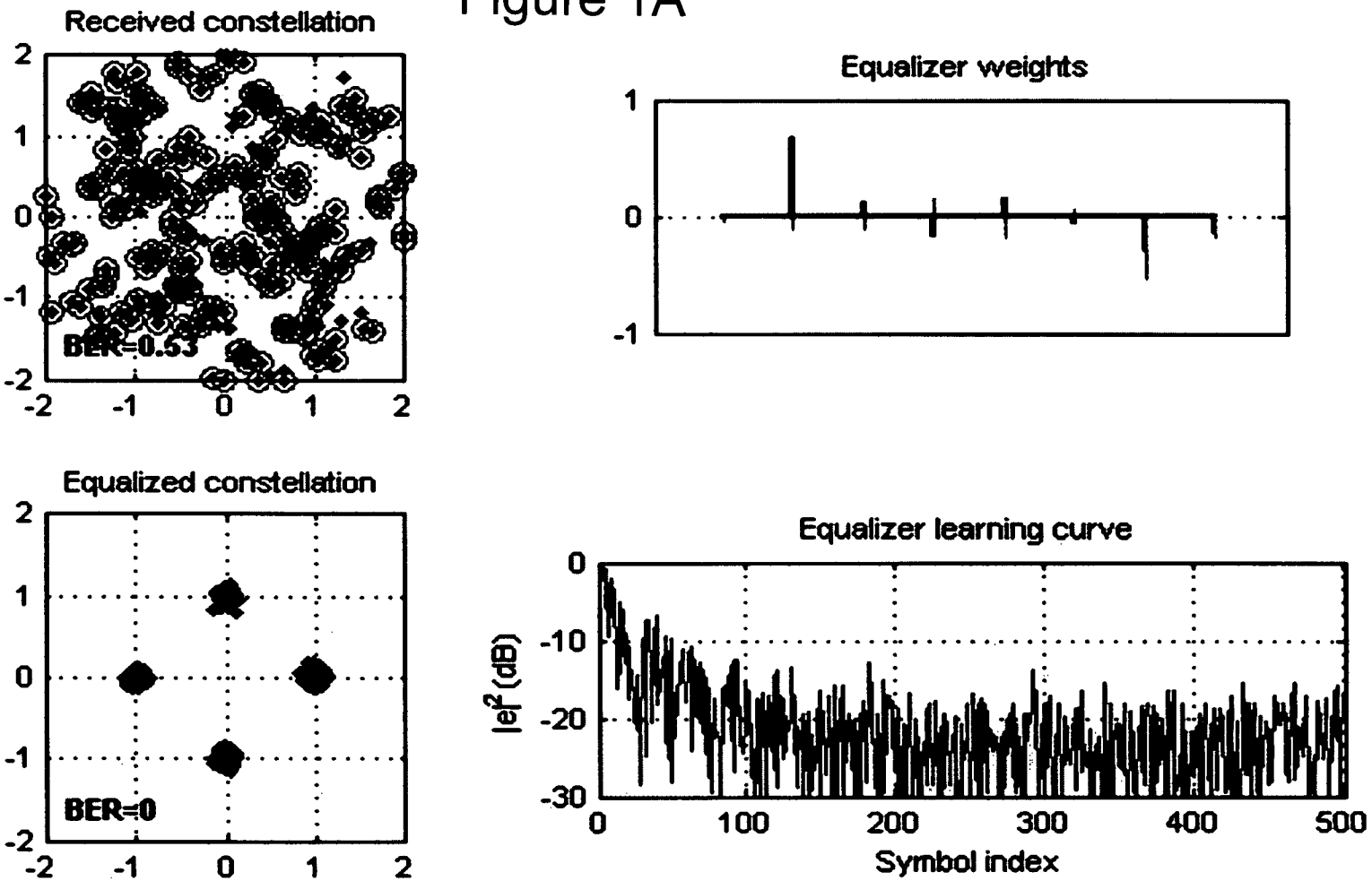
FIGS. 1A-1D illustrate signal constellation and equalizer weight convergence performance in the presence of AWGN and α-stable noise interference.

The present invention is directed to the use of heavy-tail distributed waveforms like those derived from truncated α-stable sequences to jam a channel in which communication receivers are operating.

In general, a direct closed form expression for the α-stable (also known as Levy skew alpha-stable) probability distribution family or its truncated forms does not exist. Closed form expressions for the characteristic function (CF) (ϕ do exist, CF being the Fourier transform of the PDF of the α-stable probability distribution family. The characteristic function (ϕ of the α-stable distribution $[f_\alpha(\gamma, \beta, \mu)]$ is a function of four (4) variables α, γ, β and μ. α-stable distributions are stable distributions whose dominant shape is a heavy-tail characterized by the parameter $\alpha(\alpha\epsilon(0,2])$ (the index of stability or characteristic exponent). The parameter α can also be thought as a measure of impulsiveness. If both the skewness (β) and location (μ) parameters are zero (β=0, μ=0) then a distribution is referred to as "symmetric α stable" (SαS). SαS distributions are described only by α and γ, and their corresponding CF take the form $\phi=e^{-\gamma|t|^\alpha}$. The parameter γ is the "Spread" around location parameter μ (which is not always equivalent to mean) and is similar to variance in $2^{nd}$ order processes. Closed form PDFs for α-stable distributions are known for only three cases: for α=2 the PDF becomes the Gaussian distribution; for α=1 the PDF becomes the Cauchy (or Lorentz) distribution; and for α=0.5 the PDF becomes the Levy distribution. The probabilities for all other values of α have to be determined numerically or by look-up table.

Jamming with Finite Power

Heavy-tailed distributions, like those in the class of α-stables, do not have bounded variances. Generating jamming waveforms whose amplitudes are α-stable distributed is not realistic since infinite power would be required. To ensure that finite power can be used, one way is to alter the heavy-tailed distribution in a way by which the desirable properties of the distribution are retained but their variance becomes finite. Simple methods in achieving this would be to remove large values from the distribution by either truncating or limiting the magnitudes of the distribution to values less than some upper limit K. Truncation has theoretical justification at least with respect to Levy distributions and is known as a "truncated Levy distribution" (TLD). The truncated Levy is denoted as $L_{TRUNC}(x)$ defined by:

$$L_{TRUNC}(x) = \begin{cases} 0, & x < -K \\ cL(x), & -K < x < K \\ 0, & x > K \end{cases}$$

The distribution $L_{TRUNC}(x)$ is a function of 5 parameters: the four of the Levy distribution L(x), and K the cutoff value. The cutoff value results in a very interesting property for TLDs, namely they have finite moments of order greater than or equal to two (≧2). The parameter K must be selected for jamming to achieve the intended disruptive effect (i.e., increased bit error rate (BER)). The constant c is a normalization factor.

Implementation of the Invention

Figure 1B:
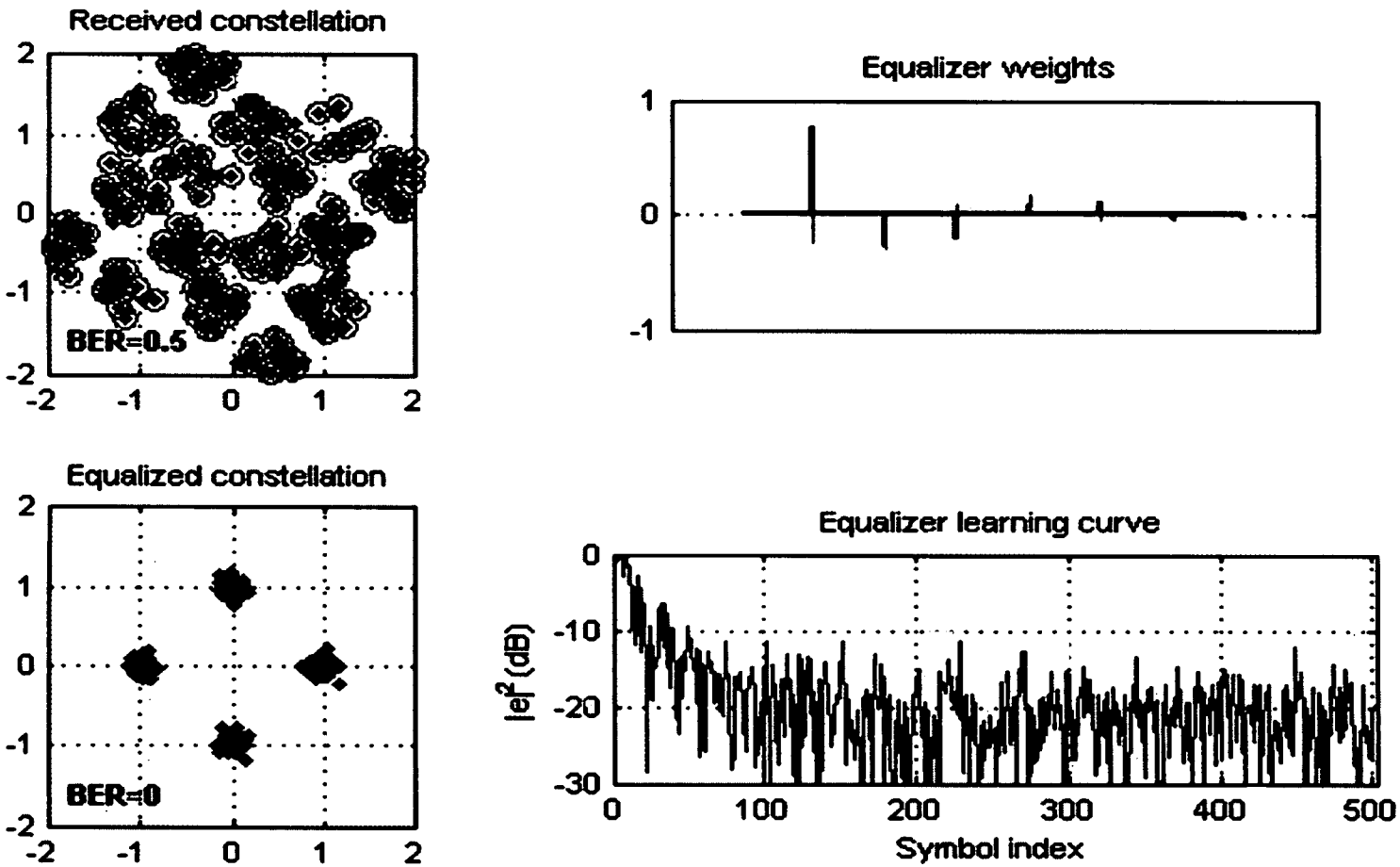
Figure 1C:
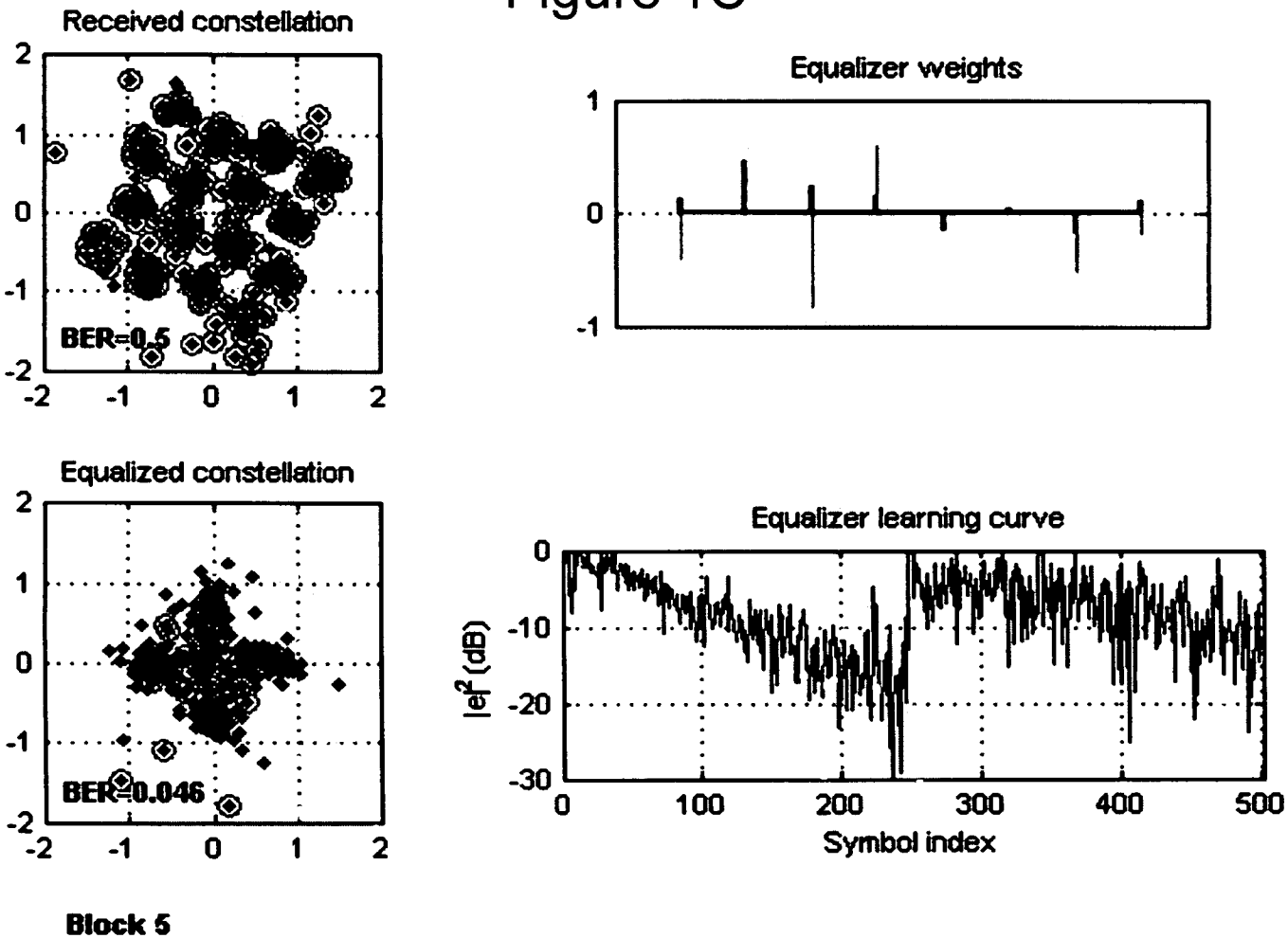
Figure 1D:
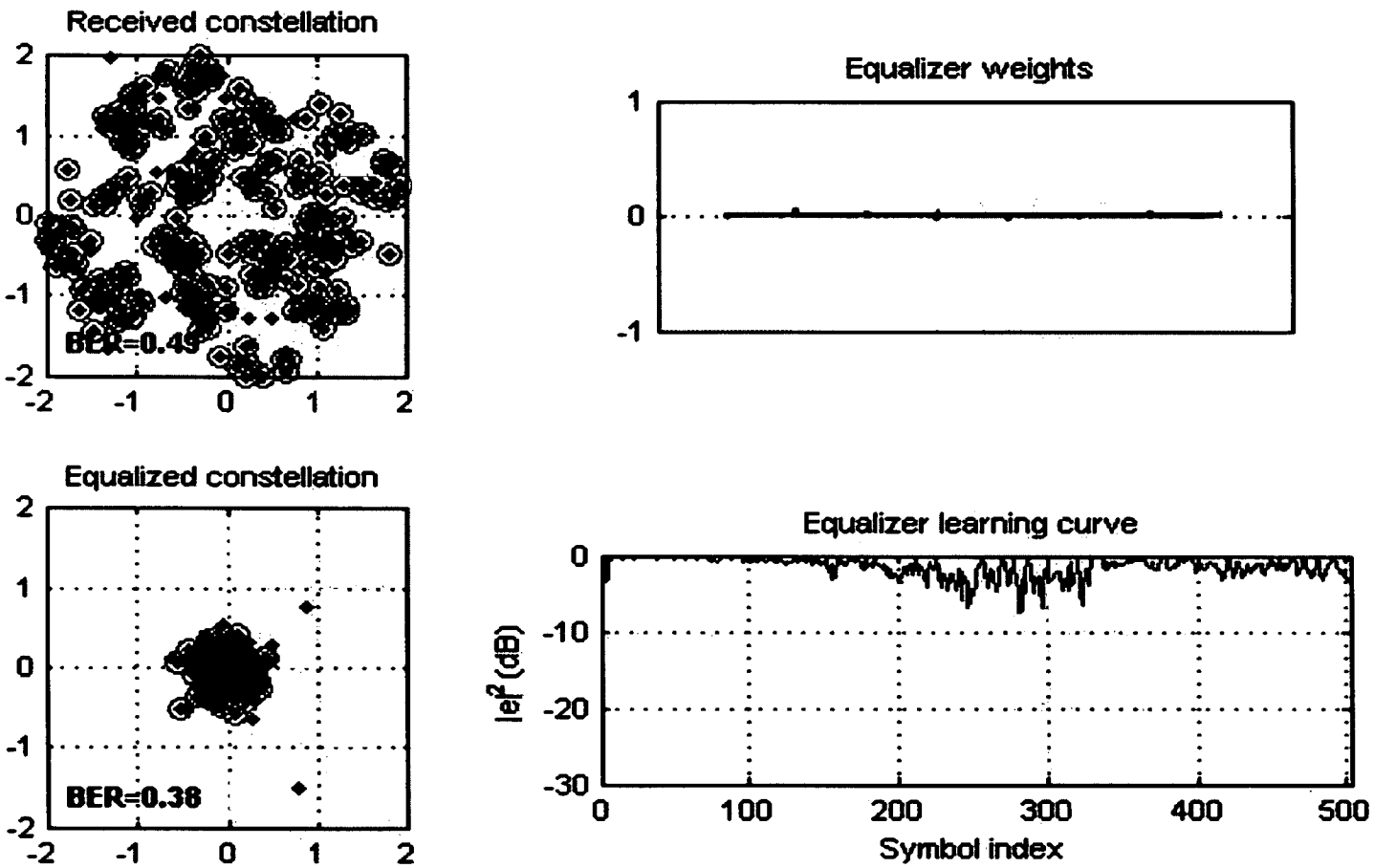

As a first step in the implementation of the present invention, tests were conducted, wherein an additive α-stable noise in lieu of AWGN interference was used in a simulation platform implementing an adaptive equalizer. FIGS. 1A-1D illustrate the simulation results for AWGN interference (FIGS. 1A and 1B) and truncated α-stable Cauchy (α=1) noise interference (FIGS. 1C and 1D). The additive α-stable noise was scaled to be of equal power to the AWGN noise. The ability to compute second order moments of truncated or limited distributions facilitates the comparison of α-stable and AWGN noise based jamming waveforms. FIGS. 1A and 1C illustrate the linear equalizer while FIGS. 1B and 1D illustrate the feedback equalizer. QPSK modulation was used as the communication signal constellation. As illustrated in FIGS. 1A-1D, the equalizer is able to converge and the signal constellation is reconstructed in the AWGN interference environment. The non-AWGN environment however precludes equalizer convergence and the signal constellation cannot be reconstructed. This causes the system performance to be significantly degraded and the resulting BER and packet error rate (PER) to be high.

Following these initial "proof-of-concept" experiments, a general evaluation platform was developed to test, validate, analyze, and determine the performance of various jamming waveforms on narrowband communications systems, such as GSM, incorporating different FEC coding and coherent methods of demodulation. The waveforms designed according to the present invention, showed a much higher effectiveness, as opposed to those based on Gaussian noise, in jamming a large variety of modern communication systems. These waveforms include the class of Pareto and Levy α-stable "noise signals" modulating a second random noise signal in a stationary or non-stationary manner.

Jamming Waveforms

The class of waveforms disclosed here makes use of heavy-tail distributed random variables. This class of jamming waveforms will be broadly categorized in two types: Signal Type I and Signal Type II.

Signal Type I: Truncated and Limited Heavy-Tailed Distributions

Signal Type I waveforms are obtained from heavy-tailed distributions by the process of censorship or limiting. Signal Type I waveforms are ideal in disrupting communications/radar processes where, in general, relatively unquantized bursty signals are processed for detection purposes. Relatively unquantized processes can occur when the intended receiver, by nature (like software based receivers) or the specific design of its receiver algorithms, assumes a substantial number of input bits. General α-stable processes can cause large degradations to the BER, PER, and synchronization performance of modem communication systems.

The truncated $\alpha$-stable distribution is a function of five parameters: the four of the $\alpha$-stable distribution, and K, the cutoff value. For jamming applications K is selected so that the intended disruptive effect (i.e., increasing BER) is maximized.

The truncated $\alpha$-stable noise sequence is generated by a process of censorship:

a. an $\alpha$-stable distribution is generated;

b. each random variable x is compared to the cutoff value K;

c. if $|x| \geqq K$ the sample is discarded;

d. otherwise the sample is kept.

Another aspect of the invention when using Signal Type I jamming is to use limiting instead of truncation. By limiting, if the variable exceeds the value K in magnitude, its magnitude is set to K. The sign of the variable is retained.

In the case of complex variables, the use of truncation or limiting can be applied either separately to the real and imaginary components of the complex variables as described above, or to the composite complex variables. For the case of composite complex variables, the magnitude of each variable is tested against K. In the case where the magnitude exceeds K the phase of the variable is retained with its magnitude set to K.

Figure 2:
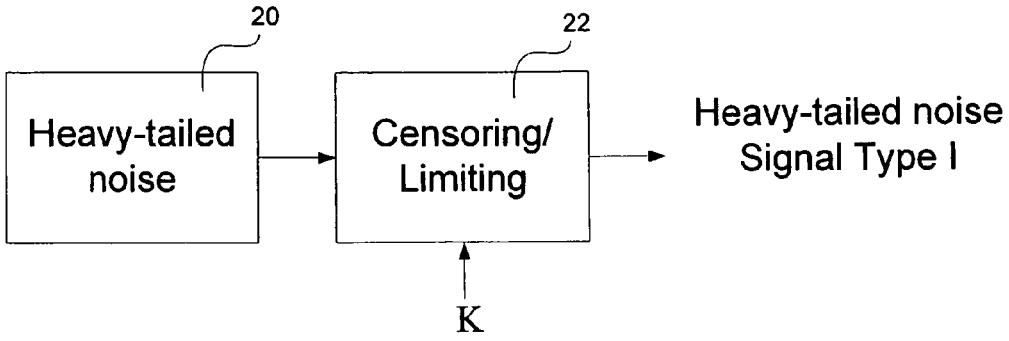
FIG. 2 illustrates a Signal Type I waveform generation in accordance to the present invention, wherein finite variance heavy-tailed noise is generated.

FIG. 2 depicts an example for constructing Signal Type I jamming waveforms. Here, an $\alpha$-stable distributed signal generator 20 connected to a censoring/limiting device 22 is used. The censoring/limiting device allows the complex variables to pass through when their magnitude is below K and either removing variables whose magnitude is above K in case of censoring or limiting their magnitude to K while maintaining their phase in case limiting is used. In the case of censoring, new variables are generated to replace the ones removed. The new variables are also subject to the same censoring rule.

Signal Type II: Non-Stationary $\alpha$-Stable Modulated Signals

The Signal Type II jamming signal is constituted from noise generated from a standard normal distribution N(0,1) that undergoes a time-varying modification of its variance. These modifications can be made in a periodic manner, as in every $\tau$ seconds, or more generally in a continuous manner. Specifically, for the periodic case, the random N(0,1) noise signal is multiplied for the duration of each time interval by a (different) random value $\alpha_k$ drawn from a heavy-tailed $\alpha$-stable distribution. The random variable $\alpha(t)$ remains constant for the duration of the k-th interval $k\cdot\tau \leqq t < (k+1)\cdot\tau$ (for k=1, 2, . . . ). This multiplication causes the variance of the random N(0,i) noise to take a different random value during each time interval. The variance during the k-th time interval, denoted by $v_k$ is:

$$v_k^2 = \sigma^2(t)_{k\tau \leqq t < (k+1)\tau} = \alpha_k^2$$

and the Signal Type II signal is of the form $I(t_k)=N(0,\sigma_k^2)$ (or $I(t_k=N(0,v_k^2))$ The case of periodically changing the value of $\sigma^2(t)$ could be relaxed to the case where $\sigma^2(t)$ changes in a continuous albeit slow manner. This jamming signal is non-stationary: it is formally known as a modulated normal distribution of the form $N(0,\sigma^2(t))$ or $N(0,\sigma^2(t_k))$, i.e., a normal distribution with time-varying variance. Although time-varying jamming has been used in the past, the jamming signals have not been generated by the product of two noise sources as in the present invention.

The time-varying multiplication factors need not be drawn from a single $\alpha$-stable distribution with fixed characteristic index $\alpha$; the time-varying multiplication factors can, for example, be drawn from the entire class or subset of $\alpha$-stable distributions, with the value of a randomly selected $\alpha$ during each interval of duration $\tau$ seconds.

Jammer Operation

Figure 3:
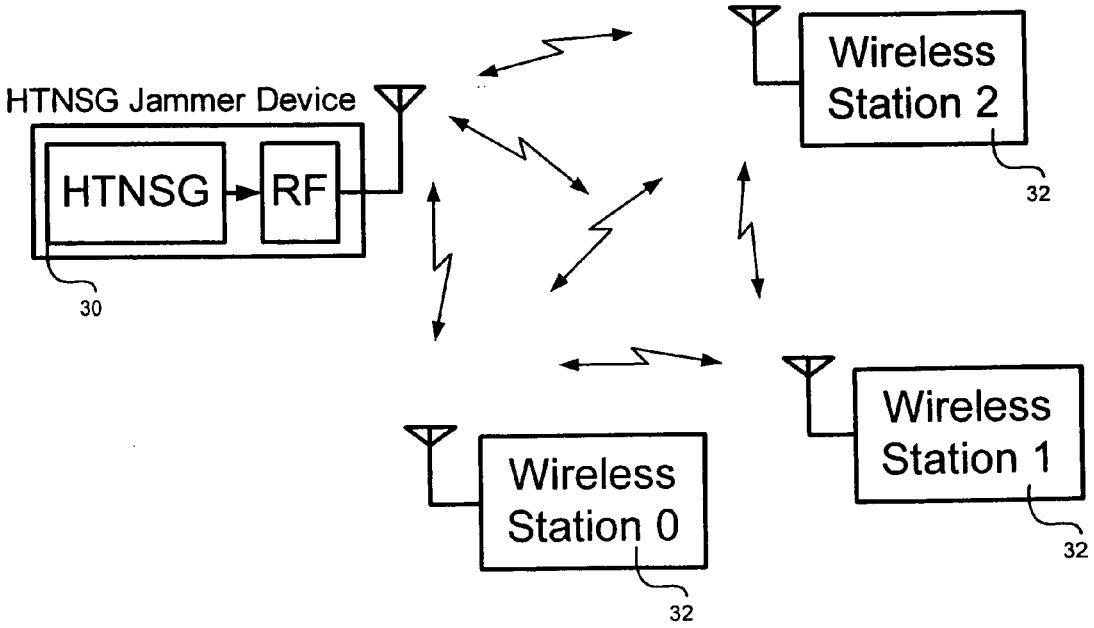
FIG. 3 shows a heavy-tail nonstationary signal generator (HTNSG) based jammer emitting the jamming waveform(s) in order to disrupt the communication links between stations.

The general deployment aspects of the jammers utilizing the disclosed waveforms are shown by example in FIG. 3. As shown, the HTNSG based jammer device 30 emits the jamming waveform according to the disclosed invention in order to disrupt the communication links between three Stations 32, namely Station 0, Station 1 and Station 3. When the jammer device 30 wants to disrupt the communication links between the Stations, the jammer will start emitting the HTNSG type of jamming over the air at the frequency bands the Stations are assumed to operate. When for example Station 0 transmits information to Station 2, the jammer device 30 may choose to transmit HTNSG type jamming signals in the frequency band used by Station 0 to transmit to Station 2. The Station 2 will receive both the signal transmitted by Station 0 and by the jammer device. Due to the nature of the jamming waveform, Station 2 will not be able to correctly decode the data transmitted by Station 0 at a level of reliability needed for communication. Station 0 will then stop transmitting information since there will be no positive acknowledgement received for the data being transmitted, or continue to transmit until all data intended for transmission have been transmitted over the air.

First Embodiment

Heavy-tail Noise Generator

Figure 4:
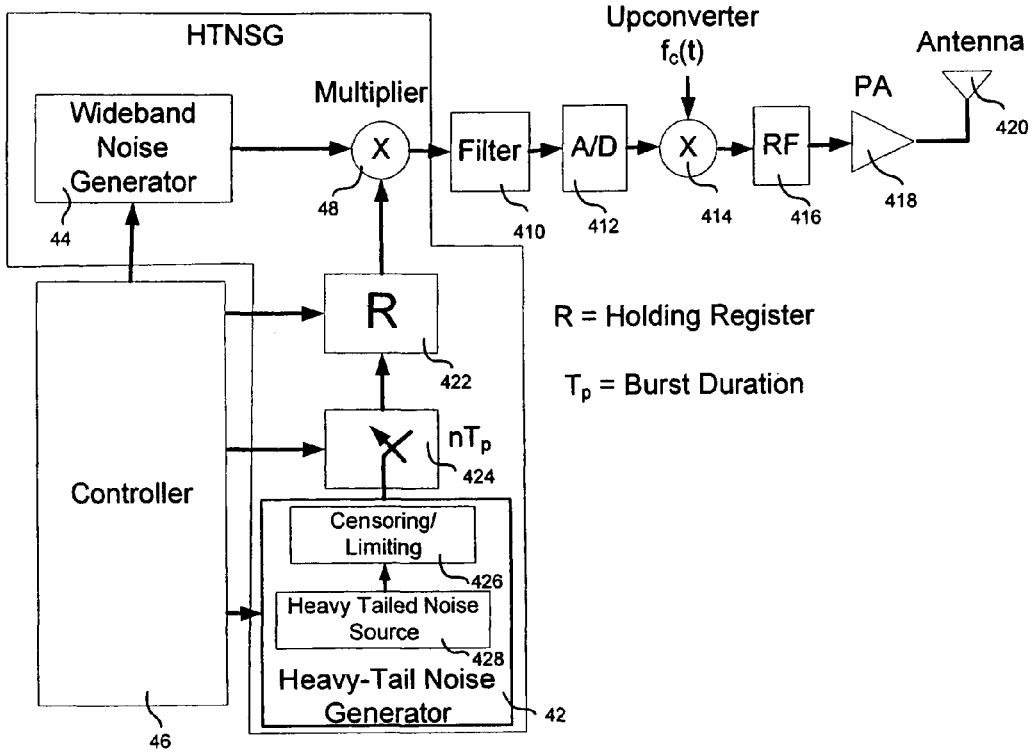
FIG. 4 shows a general depiction of Signal Type II HTNSG according to the present invention.

FIG. 4 illustrates a first embodiment of a jammer device 40 of the present invention. In FIG. 4, the heavy-tail noise source or generator 42 generates a pair of heavy-tailed noise variables every $T_P$ seconds, wherein the controller 46 sets the parameters for the operation of the heavy-tailed noise generator 42 and a wideband noise generator 44. The heavy-tailed noise generator variables are then stored in Register R 422 for a $T_P$ duration. During that time interval, the contents of register R 422 are used to multiply all the pairs of outputs from the wideband noise generator 44. A gate device 424 is operatively connected to receive the periodic heavy-tail noise variable of the heavy-tail noise generator 42 and configured to output a predetermined number n of samples of the periodic heavy-tail noise variable to the Register R 422. The number of samples multiplied per time period $T_P$ will depend on how much faster the wideband noise generator 44 generates pairs of wideband noise variables (i.e., its bandwidth) versus that of the heavy-tail noise generator. The heavy-tailed noise generator consists of a heavy-tailed noise source 428 and a censoring or limiting device 426 that are the same as or similar to those previously described in more detail using FIG. 2. The multiplier 48 is a complex multiplier operating on two heavy-tailed noise samples and two wideband noise generator outputs for each pair of wideband noise generator outputs. Multiplying complex signals is well known in the art and will not be discussed in further detail herein. Complex jamming waveforms will be more effective on BPSK types of modulation signals and more difficult to be removed by jamming mitigation techniques. The overall system, however, could also be operated using real only noise signals. The output of the multiplier 48 is then put through a low pass filter 410 so that the transmitted energy after the signal has been upconverted is concentrated within the band where to signal to be jammed operates, and a Digital-to-Analog (D/A) converter 412 before being frequency up converted by the Up-converter 414. The frequency up-converter 414 shifts the jammer signal to the RF frequency $f_c(t)$ of the link to be jammed. The RF circuit 416 eliminates signal spectral images which fall outside the frequency band of interest. Another configuration of this jammer device 40 may be to use a heavy-tail noise source 42 which is of considerably lower bandwidth than that out of the wideband noise generator 44. The ratio between the two bandwidths needs to be very carefully selected. The α-stable random variables before being stored in the register R are either being censored or limited in magnitude by the controller 46 according to the value K.

The product of the slow and optionally discretely varying heavy-tailed process with the filtered Gaussian process modulates a carrier frequency which is then transmitted through the air with the use of a radio unit implemented via the RF circuit 416, the power amplifier 418 and an antenna 420. The main purpose of the filter 410 in this case is to restrict the transmitting energy to reside within the frequency band(s) of the communication link to be jammed.

The discrete heavy-tailed distribution process superimposed upon the Gaussian process is responsible for disrupting the operation of 'slow' receiver processes. Here it is of paramount importance to match the heavy-tailed update interval r or coherence interval to the 'time constant' of these slower communication processes. Prime examples of slow receiver processes are FEC and Automatic ReQuest (ARQ) processes. Other slow receiver processes could be affected as well. Examples of these are Automatic Gain Control (AGC), Frequency Lock Loop (FLL), and Delay Lock Loop (DLL), among others.

Figure 5:
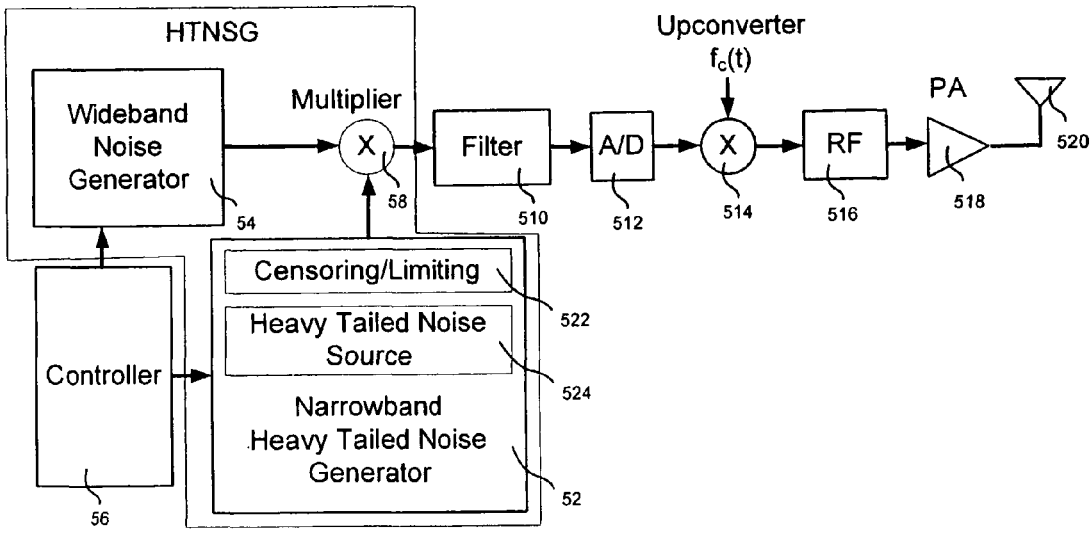
FIG. 5 shows a variant of Signal Type II HTNSG according to the present invention.

The case of using a continuous time narrowband heavy-tail noise generator 52 to generate a Signal Type II jamming waveform is shown in the embodiment of a jammer device 50 in FIG. 5. Here continuous time refers to generation of a different heavy-tailed noise variable for every wideband noise variable generated. Due the narrowband nature of the heavy-tail noise variable generator, the heavy-tailed noise variables are correlated to each other utilizing various known correlation techniques. One applicable technique is to repeat the same heavy-tailed noise variable generated by the heavy-tailed noise source 524 after the censoring or limiting operation by the censoring/limiting device 524. This will make the operation of the jammer device identical to that of the system described in FIG. 4. Another technique is to implement a combination of repetition with a known low pass filtering operation. The filtering operation must be structured so as not to greatly alter the heavy-tailed nature of the resulting narrowband waveform amplitude distribution. The bandwidth of the narrowband heavy-tailed noise variable will typically be much smaller that the bandwidth of the wideband noise variable generator. Like the jammer device 40 of FIG. 4, in the jammer device 50, the controller 56 sets the parameters for the operation of the narrowband heavy-tail noise generator 52 and a wideband noise generator 54. The multiplier 58 is also a complex multiplier having as its inputs narrowband heavy-tailed noise and wideband noise generator outputs. The output of the multiplier 58 is then passed through a low pass filter 510 and converted to the analog domain by the D/A converter 512. The frequency up-converter 514 shifts the jammer signal to the RF frequency $f_c(t)$ of the link to be jammed. The RF circuit 516 removes unwanted signal spectral images. The resulting modulated carrier frequency is then transmitted through the air with the use of the power amplifier 518 and the antenna 520.

Figure 6:
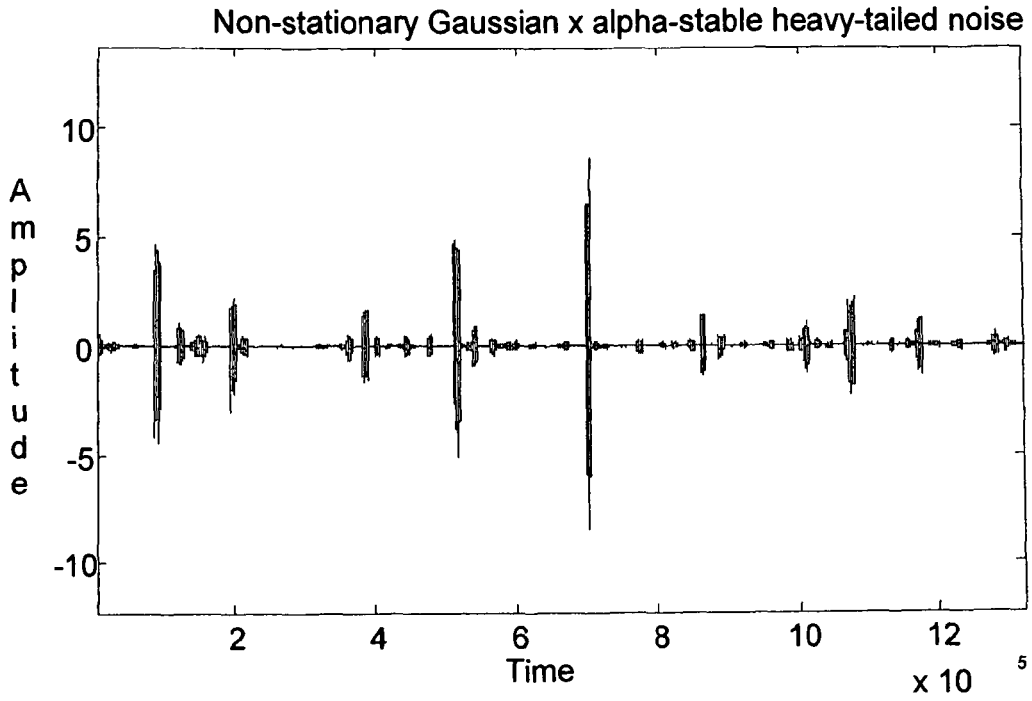
FIG. 6 depicts the time-domain representation of the output process derived by the multiplication of the discrete α-stable process with a unit variance Gaussian process for some chosen value of the parameter K.

FIG. 6 depicts the time-domain representation of the output process derived by multiplication of a discrete censored α-stable process with a unit variance Gaussian process for some chosen value of the parameters. This generates a Signal Type II jamming waveform; here referred to as a α×G. The nonstationary nature of the output is evident. It is noted that when the interval parameter $T_P$ is chosen to be small, the resulting process will become similar to that of that of Signal Type I.

Figure 7:
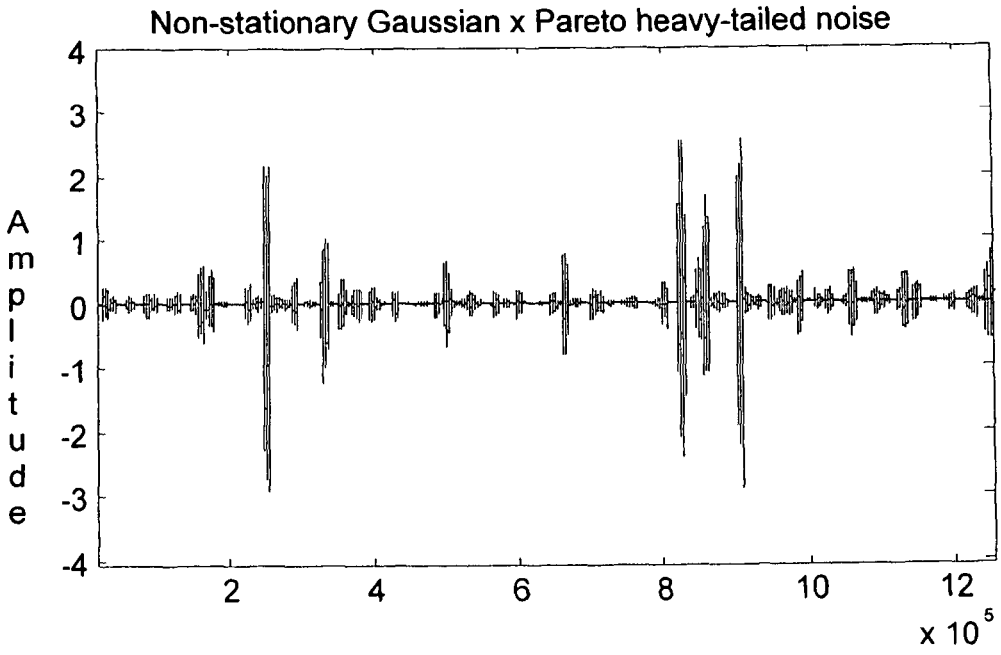
FIG. 7 shows the use of a different heavy-tailed process with a distribution described by the product of a Pareto distribution with a unit variance Gaussian process.

FIG. 7 depicts a different heavy-tailed process instead of α-stable. The distribution shown is described by the product of a Pareto distribution with that of a unit variance Gaussian process. This generates a Signal Type II jamming waveform; here referred to as Ψ×G. Again, the censoring or limiting parameter K is used in order to keep the resulting trend with Pareto as the one observed with α-stable. Similar behavior was encountered when these similar waveforms are used as jamming waveforms.

Figure 8:
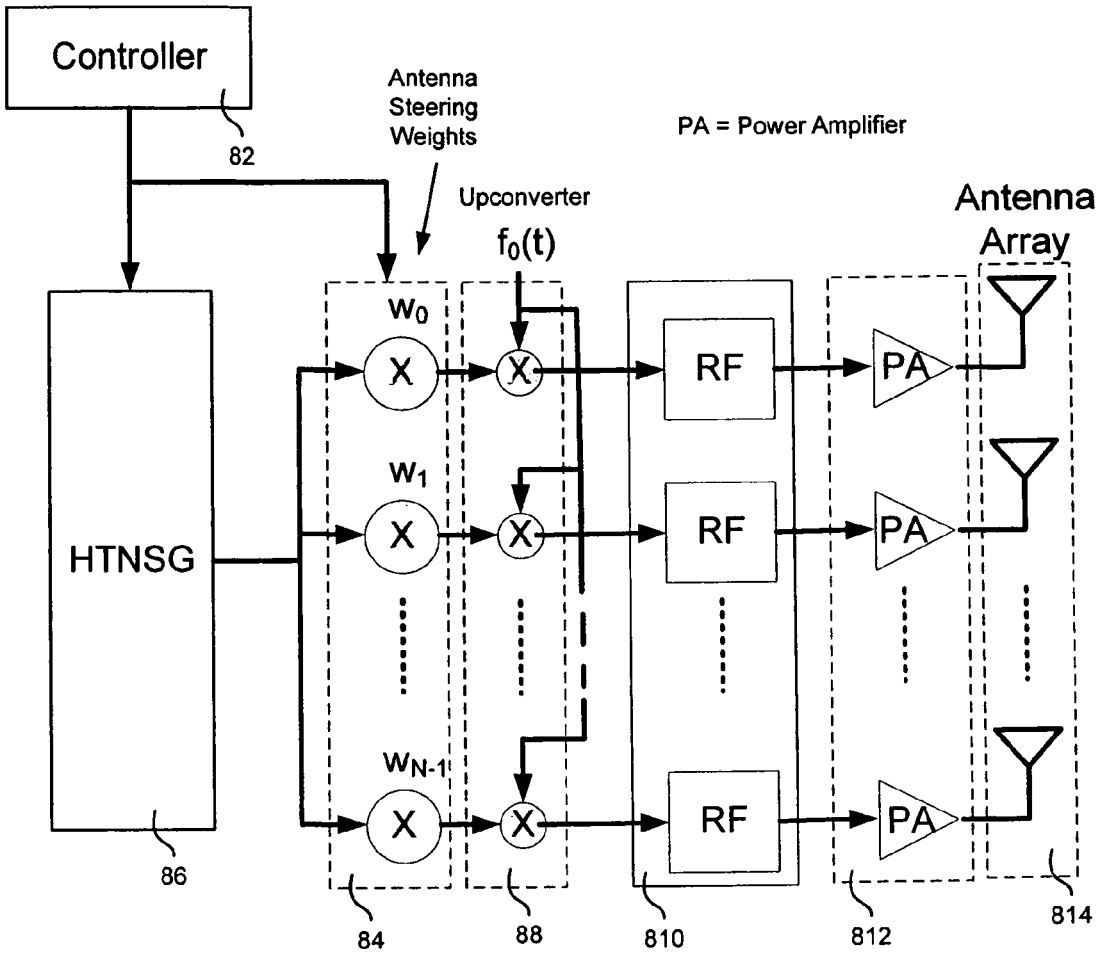
FIG. 8 illustrates a jammer specified to use the HTNSG based jammer implementation capable of spatially directing the radio energy towards a particular well chosen spatial domain.

To gain a jamming power advantage, a beam-steering or electronic scanning mechanism is used to selectively direct transmitted energy to a spatial region where the signals to be jammed have been geo-located. This type of jamming device 80 is depicted in FIG. 8. The controller 82 is a digital device which receives information through external means about the direction of origin of the signals to be jammed in relationship to the jammer 80, and that computes the values for the appropriate electronically scanned beam-steer antenna weights 84 where $w_i$ (i=1, 2, . . . , N−1). The HTNSG jammer device 86 generates jamming signals as a plurality of antenna beams. The weights 84 are used to weigh each antenna beam individually, with the resulting waveforms then being up-converted by the upconverter circuit 88 to the same carrier frequency before processed by the bank of RF components 810, amplified by the power amplifier bank 812 and transmitted by the array of antennas 814. Concentrating jamming into a specific region results in considerable gains over omni-directional jamming.

The Applicants are proponents of using α-stable random variables as the preferred heavy-tailed distributions because of the control available over their impulsiveness through a finite number of theoretically rigorous parameters. However, other heavy-tailed distributions such as Gaussian noise (as a limiting case of α-stable), α-stable distribution, Pareto distribution, Compound Poisson, and Gaussian Scale Mixture are also applicable. Note that although Gaussian noise itself is light-tailed, the PDF of the product of two Gaussian random variables is heavy-tailed. Hence we include the case of a Gaussian×Gaussian by virtue of the fact that the Gaussian distribution is a subset of the alpha-stable distribution, and that the PDF of a Gaussian×Gaussian sequence is heavy-tailed.

Second Embodiment

Additional Configurations of the HTNSG Jammer

The HTNSG based jammer is robust and can be configured in a number of ways to address specific denial of service requirements. Specifically, a variant of the device 90 designed for multiple channel denial of service is shown in FIG. 9.

Truncated heavy-tailed distributions have finite variance: when multiple truncated or limited α-stable distributions are summed together, they tend to converge to a Gaussian distribution, due to their finite variance property. The resulting Gaussian-like distributed signal has advantages for implementation in power amplifiers. In addition, this configuration has a counter-counter measure advantage in that it shields the individual nature of the HTNSG jammer's comprising the final Gaussian-appearing signal.

Figure 9:
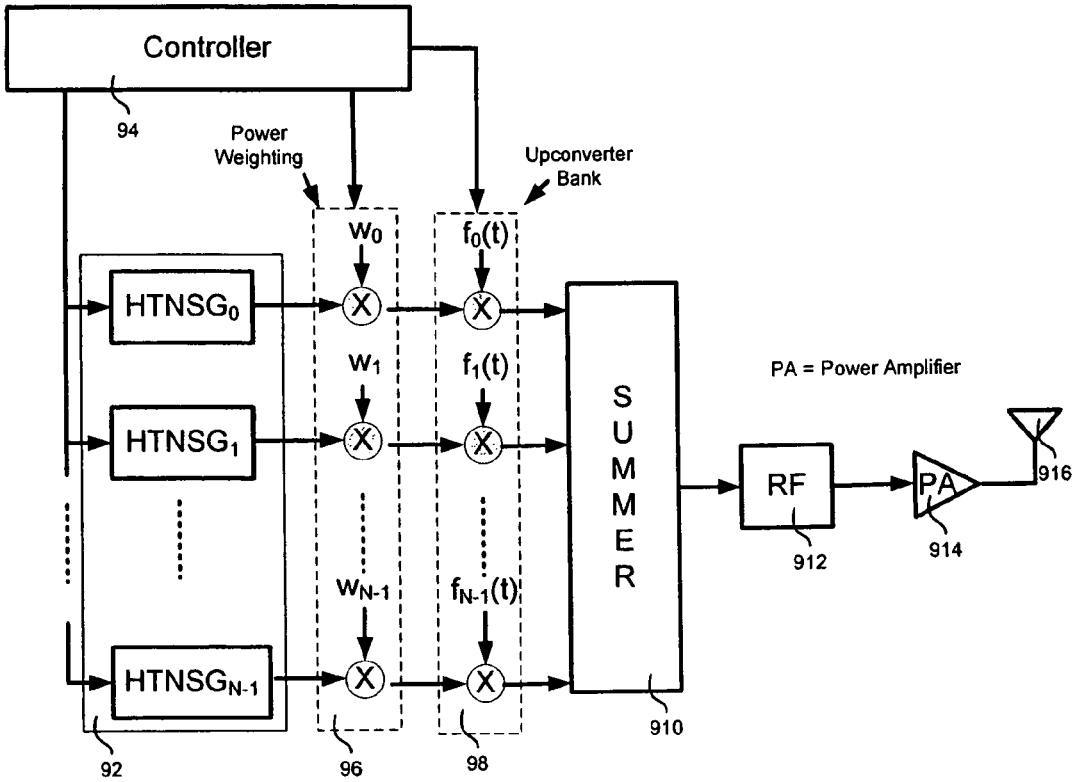
FIG. 9 shows a variant of the multiple channel denial of service.

In FIG. 9, the HTNSGs 92 are used to generate individual and independent jamming signals for the purpose of jamming different links operating at disjoint frequency bands. The outputs of the HTNSGs 92 are in baseband form. These outputs are each power weighted via a bank of power weights 96, and then frequency modulated to intermediate frequencies via the frequency up-converter bank 98, wherein the intermediate frequencies are all at a constant frequency shift from the final frequency bands to be jammed. The resulting frequency modulated signals are then inputted into a summer 910. The summed carrier frequencies are frequency shifted to their final carrier frequencies via the RF circuit 912, amplified through the power amplifier 914, and then transmitted over an antenna element 916.

The intermediate frequencies outputted from the up-converter bank 98, as well as a common frequency shift performed by the RF circuit 912, can be flexible to take any desired values. This makes the overall composite jammer 90 very powerful as it can jam a large number of signals at the same time as well as follow the signals to be jammed in frequency, in case they do move around in the frequency domain. The controller 94 performs a weighting function through the power weighting bank 96 to distribute the overall PA power to the jammed channels. This allows the system to allocate power to individual channels on an "as needed" basis and retain the ability to jam as many channels as possible. At any time, the number of channels to be jammed can change according to the activity and transmitted power level, as determined by the controller 94.

Third Embodiment

Controlling HTNSG Based Jammer Operations

Figure 10:
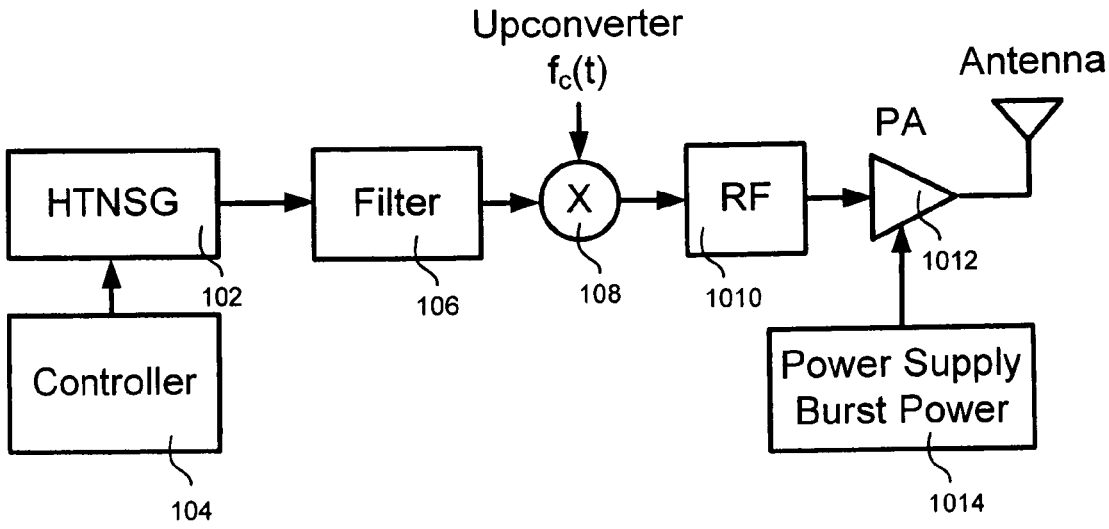
FIG. 10 shows the HTNSG being controlled by a controller which determines all the parameters the signal generator needs to operate and controls the timing of its operations.

FIG. 10 illustrates another embodiment for a jamming device 100. In FIG. 10, the HTNSG jammer 102 is controlled by a controller 104 which determines all the parameters the HTNSG jammer 102 needs to operate and control the timing of its operations. The HTNSG jammer parameters can be time-varying. The output of the HTNSG jammer 102 is first low pass (pass-band) filtered by the filter 106, and then up-converted to the frequency band to be jammed using the complex multiplier 108 by $f_0(t)$. The low pass (pass-band) filter contains the transmitted energy to the frequency band(s) to be jammed. A pass-band filter can be used for jamming a number of distinct frequency bands concurrently. The up-converted signal can then be transmitted at that frequency using the RF block 1010, or be up-converted further and transmitted by the RF block 1010. Here, the power supply 1014 of the RF block 1010 and power amplifier block 1012 is designed as to provide large instantaneous power output over short time intervals in an efficient manner. Likewise, the power amplifier 1012 is designed so that it is very efficient in amplifying large signal excursions without altering its actual shape.

Fourth Embodiment

Active HTNSG Jammer

In another embodiment, the jammer device 110 is designed to periodically sense the environment to determine if there are any operational RF links it would need to disrupt. The jammer device 110 could also decide not to jam an RF link continuously but rather intermittently, for the purpose of saving battery energy. Furthermore, the jammer might want to jam only a certain number of the RF links on the air only because it does not have enough power to jam all the links, or for any other reasons.

Figure 11:
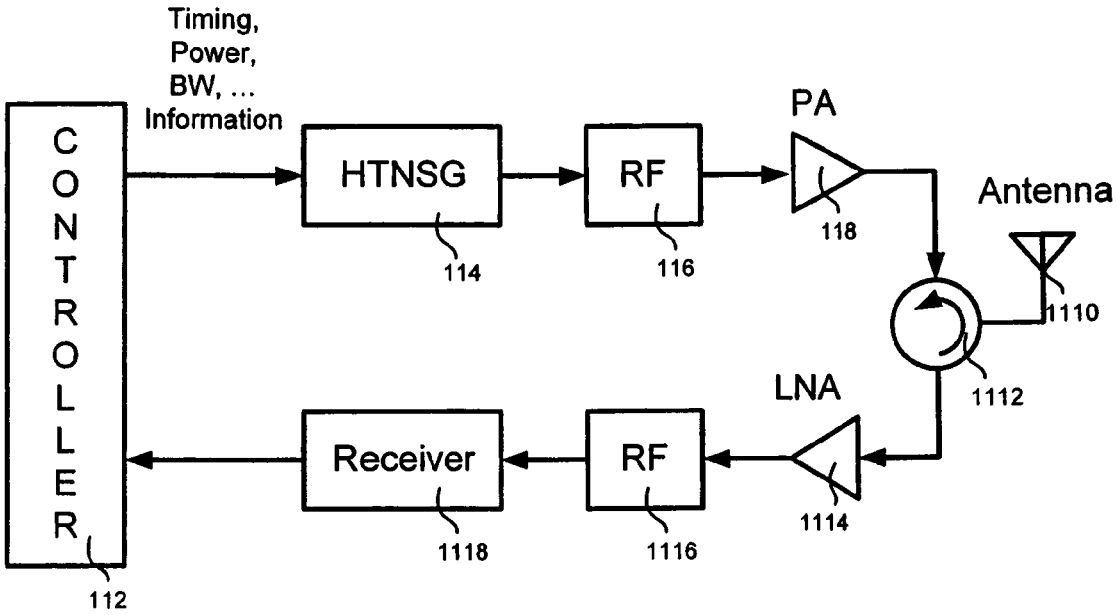
FIG. 11 illustrates an active HTNSG based jammer device configuration having the capability of listening to the radio environment and determining the threat signals and their parameters before determining what frequency to jam and what other parameters are to be used by the jammer.

The described active jammer configuration 110 has the capability of listening to the radio environment and determining the threat signals and their parameters before determining what frequency to jam and what other parameters are to be used by the jammer. This is depicted in FIG. 11. Parameters controlled by the controller 112 include: timing, bandwidth, power, type of noise distribution to be used for each signal, how many signals to be jammed, etc. The parameters for the HTNSG jammer 114 may also depend on the frame duration used by the threat signals. The frame duration, which is also related to the interleaver time span used by the threat device will dictate how fast to adjust the generation of the heavy-tailed random variable generation. It is of great importance, when the interleaver time span used by the threat device is known or can be determined by intercepting its transmission, to be used to set the switching parameter $T_P$ of the HTNSG jammer 114. Thereby, the controller 112 in FIG. 11 has the capability to analyze the information derived by the receiver 118 and derive an optimum value for the parameter $T_P$. The preferred choice is to match or set the parameter $T_P$ close to the estimated duration of the received signal forward error correction interleaver time span. In the case where the heavy-tailed noise generator relies on generating a continuous time narrowband heavy-tailed noise signal, the controller will derive a ratio value representing the bandwidth ratio of the narrowband heavy-tailed noise generator to that of the wideband noise generator.

In the active jammer configuration 110 of FIG. 11, the output of the HTNSG 114 is passed through the RF/IF circuit and filter 116 which converts a baseband signal into an RF signal for transmission through an antenna after proper amplification. The resulting jamming RF/IF signal is then power amplified by the power amplifier 118 and then outputted from a switching device 1112 so as to be transmitted by the antenna 1110. The switching device 1112 can also switch to an input mode so as to receive RF signals present in the environment. The received RF signals are first passed through a Low Noise Amplifier (LNA) 1114 and then through a RF/IF circuit and filter 1116. A receiver 1118 receives the processed received signals in order to develop necessary jamming parameter information for controlling the transmitting portion of the jammer. That jamming parameter information is passed to the controller 112 which in turn configures the jamming signals to be generated. One implementation for the switching device 1112 is as a multiplexing circuit so as to continuously switch between outputting a jamming signal and receiving RF signals. It is the preferred option to time multiplex the operation of transmitting and receiving, however, those two operation are possible to be carrier out simultaneous by operating on sufficiently disjoint receiving and transmitting bands.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims, unless they depart there-from.

We claim:

1. A wireless communications jamming device, comprising:

a heavy-tail noise generator for periodically generating a heavy-tail noise variable;

a register for storing the periodically-generated, heavy-tail noise variable;

a wideband noise generator for generating a wideband noise variable at a rate higher than that of the heavy-tail noise generator;

a multiplier configured to multiply the wideband noise variable with the stored periodically-generated, heavy-tail noise variable, and thereby generate a multiplied wideband output signal to be transmitted as a jamming signal; and a censoring device for censoring according to a censoring threshold value the periodically-generated, heavy-tail noise variable generated by the heavy tail noise generator.

2. A wireless communications jamming device according to claim 1, further comprising:

a limiting device for limiting according to a limiting threshold value the periodically-generated, heavy-tail noise variable generated by the heavy tail noise generator.

3. A wireless communications jamming device according to claim 1, further comprising:

a filter for concentrating the multiplied wideband output into a band of a link to be jammed.

4. A wireless communications jamming device according to claim 1, further comprising:

a frequency up-converter for shifting the multiplied wideband output signal to a predetermined RF frequency of a link to be jammed, so as to generate the jamming signal to be broadcast.

5. A wireless communications jamming device comprising:

a heavy-tail noise generator for periodically generating a heavy-tail noise variable;

a register for storing the periodically-generated, heavy-tail noise variable;

a wideband noise generator for generating a wideband noise variable at a rate higher than that of the heavy-tail noise generator;

a multiplier configured to multiply the wideband noise variable with the stored periodically-generated, heavy-tail noise variable, and thereby generate a multiplied wideband output signal to be transmitted as a jamming signal; and a gate device operatively connected to receive the periodically-generated heavy-tail noise variable of the heavy-tail noise generator and configured to output a predetermined number of samples of the periodically-generated heavy-tail noise variable to the register.

6. A wireless communications jamming device according to claim 5, wherein gate device is further configured to output the predetermined number of samples of the periodic heavy-tail noise variable based on a time period of Tp seconds.

7. A wireless communications jamming device according to claim 6, further comprising:

a controller operatively connected to control operation of the wide band noise generator, the heavy-tail noise generator, the gate device and the register.

8. A wireless communications jamming device according to claim 1, wherein the multiplier is configured as a real multiplier multiplying a single periodically-generated heavy-tail noise variable with single wideband noise variables from the wideband noise generator.

9. A wireless communications jamming device according to claim 1, wherein the multiplier is configured as a complex multiplier multiplying a pair of periodically-generated, heavy-tail noise variables with pairs of wideband noise variables from the wideband noise generator.

10. A wireless communications jamming device according to claim 1, wherein the wideband noise generator is configured to generate a Gaussian noise signal.

11. A wireless communications non-stationary heavy-tail jamming device, comprising:

a heavy-tailed noise generator for generating a periodic heavy-tailed noise signal derived from a heavy-tailed distribution that includes a plurality of repeated heavy-tailed distributed samples;

a low-pass filter configured to receive the periodic heavy-tailed noise signal so as to generate a narrowband noise signal;

a wideband noise generator for generating a wideband noise signal; and a multiplier configured to multiply the narrowband noise signal with the wideband noise signal, and thereby generate a multiplied jamming output signal to be transmitted as a jamming signal.

12. A wireless communications jamming device according to claim 11, further comprising:

a censoring device for censoring according to a censoring threshold value the heavy-tailed noise signal generated by the heavy-tailed noise generator.

13. A wireless communications jamming device according to claim 11, further comprising:

a limiting device for limiting according to a limiting threshold value the heavy-tailed noise signal generated by the heavy-tailed noise generator.

14. A wireless communications jamming device according to claim 11, wherein the narrowband noise generator is configured for generating a pair of narrowband noise signals derived from a heavy-tailed distribution;

the wideband noise generator configured for generating a pair of wideband noise signals;

the multiplier is configured as a complex multiplier for multiplying the pair of narrowband noise signals with the pair of wideband noise signals, and thereby generate a complex multiplied jamming output.

15. A wireless communications heavy-tail non-stationary jamming device, comprising:

a narrowband noise generator for generating a narrowband noise signal derived from a heavy-tailed distribution;

a wideband noise generator for generating a wideband noise signal; and a multiplier configured to multiply the narrowband noise signal with the wideband noise signal, and thereby generate a multiplied jamming output signal to be transmitted as a jamming signal, wherein the narrowband noise generator is configured to generate a narrowband noise signal derived from a heavy-tailed distribution of at least one of Gaussian noise, heavy-tail noise, $\alpha$-stable distribution, Pareto distribution, Compound Poisson and Gaussian Scale Mixture.

16. A wireless communications jamming device according to claim 1, wherein the multiplier is configured to multiply a plurality of wideband noise variables with each stored and periodically-generated heavy-tail noise variable.

17. A wireless communications jamming device, comprising:

a narrowband noise generator for generating a narrowband noise signal derived from a heavy-tailed distribution;

a wideband noise generator for generating a wideband noise signal; and a multiplier configured to multiply the narrowband noise signal with the wideband noise signal, and thereby generate a multiplied jamming output signal to be transmitted as a jamming signal, wherein the multiplier is configured to multiply the wideband noise signal with the narrowband noise signal, and the narrowband noise signal is fixed in amplitude for a non-zero time duration $T_p$.

* * * * *